United States Patent [19]

McGrath et al.

[11] Patent Number: 4,997,209

[45] Date of Patent: Mar. 5, 1991

[54] UNIVERSAL ADAPTER SLEEVE FOR CENTRAL VACUUM CLEANING SYSTEMS

[75] Inventors: Robert F. McGrath, Louisville; Donald V. Bailey, Canton, both of Ohio

[73] Assignee: H-P Products, Inc., Louisville, Ohio

[21] Appl. No.: 427,610

[22] Filed: Oct. 26, 1989

[51] Int. Cl.[5] ..... A47L 9/24

[52] U.S. Cl. ..... 285/7; 15/314; 285/177; 285/332

[58] Field of Search ..... 285/7, 12, 177, 237, 285/334.4, 328, 332; 15/314, 377, 301

[56] References Cited

U.S. PATENT DOCUMENTS

| | | | |
|---|---|---|---|
| 2,082,054 | 6/1937 | Herzmark | 285/334.4 |
| 2,953,806 | 9/1960 | Walker | 15/414 |
| 3,076,068 | 1/1963 | Racklyeft | 15/314 |
| 3,110,923 | 11/1963 | Berleme | 15/314 |
| 3,173,164 | 3/1965 | Congdon | 15/319 |
| 3,258,553 | 6/1966 | Breslin | 15/314 |
| 3,283,093 | 11/1966 | Bishop | 15/301 |
| 3,565,464 | 2/1971 | Wolf | 285/7 |
| 3,606,403 | 9/1971 | Medney | 285/334.4 |
| 4,072,330 | 2/1978 | Brysch | 285/332 |

FOREIGN PATENT DOCUMENTS

| | | | |
|---|---|---|---|
| WO84/03428 | 9/1984 | PCT Int'l Appl. | 15/301 |
| 411253 | 10/1934 | United Kingdom | 15/314 |

*Primary Examiner*—Eric K. Nicholson

*Attorney, Agent, or Firm*—Michael Sand

[57] ABSTRACT

A one-piece hollow sleeve molded of an elastomeric vinyl has a cylindrical rear end portion for attachment to a flexible hose of central vacuum cleaning system and has a front end portion which is slidably frictionally engageable within the inlet opening of variety of inlet valves. The front end portion is formed with a series of specifically sized and located tapered zones of varying lengths and angles of taper which enable the sleeve to be used with a variety of inlet valves having various internal diameters and lengths. A metal band is seated in a recess formed in the front end portion between certain of the tapered zones and has a length and location enabling it to contact the various pairs of contact buttons of the various types and styles of inlet valves. This universal sleeve eliminates a different hose attachment sleeve being required for each of the most common inlet valves of the most popular central vacuum cleaning systems.

16 Claims, 5 Drawing Sheets

PRIOR ART

UNIVERSAL ADAPTER SLEEVE FOR CENTRAL VACUUM CLEANING SYSTEMS

BACKGROUND OF THE INVENTION

1. Technical Field

The invention relates to central vacuum cleaning systems and in particular to an adapter sleeve for connecting the flexible cleaning hose to an inlet valve which is connected to a centrally installed vacuum producing apparatus. More particularly, the invention relates to an adapter sleeve which is able to be used with a variety of manufacturers inlet valves of varying sizes, slopes and switch pin locations.

2. Background Information

Central vacuum cleaning systems are increasing in popularity in both domestic and commercial buildings wherein a plurality of inlet valves are mounted in either the baseboard area of a wall or in a floor adjacent the wall, which in turn are connected by suitable tubing to a centrally installed vacuum producing apparatus. Most of the inlet valves have a pivotally mounted lid which conceals the inlet opening when the inlet valve is not in use. Certain of these inlet valves have limit switches built into the valve whereupon pivotal movement of the lid to the open position will actuate a switch to energize the remotely located vacuum producing apparatus to produce a vacuum at the inlet valve. Certain other types of inlet valves have a pair of spaced metal contact buttons mounted in the wall of the inlet tube which contact a metal ring on the inserted end of the hose sleeve for completing a circuit to energize the remotely located vacuum producing apparatus. These constructions insure that the vacuum producing apparatus which is usually an electric motor, is energized only when the hose sleeve is inserted into the inlet tube of the inlet valve, and that the motor is automatically deenergized upon removal of the hose sleeve from the inlet valve.

There are various manufacturers of central vacuum cleaning systems presently in the market today, each of which has its own inlet valve and inwardly disposed inlet tube, and electric switch or contact button arrangement. The interior contour, size and configuration of the inlet tubes of these manufacturers inlet valves will vary between the various manufacturers usually enabling only the particular manufacturers hose sleeve to be used satisfactory with its inlet valve. Thus, once a particular central vacuum cleaning system is installed in a building, only the particular manufacturers hose sleeve can be used with the inlet valves which will require the customer to purchase the remaining attachments and apparatus from that manufacturer.

Therefore, in order to capture a larger market share of central vacuum cleaning systems and in particular the various cleaning attachments that can be used with the system, it is desirable that a particular manufacturer's hose sleeve and thus its various cleaning attachments, can be used in most of the other major central vacuum cleaning system manufacturer's inlet valves. Thus, a homeowner having a particular central vacuum cleaning system, need not purchase all of the cleaning attachments and accessories from that manufacturer.

However, due to the various internal lengths, slopes, configurations and type of electrical contacts and the positions thereof, all of which vary somewhat between the manufacturers of central vacuum cleaning systems, an existing manufacturer's hose sleeve will probably only fit its own inlet valve and possibly one or two other manufacturer's inlet valves. It is necessary that the hose sleeve provides a sufficiently tight frictional sealing engagement between the outer surface of the hose sleeve and the interior surface of the inlet tube to provide a vacuum seal and also mechanically maintain the sleeve inserted within the inlet tube. Furthermore the hose sleeve must provide the metal contact area for engaging the internal electrical contact buttons extending into the bore of the inlet tube to energize the vacuum producing apparatus even though these button locations vary between the various manufacturer's of inwall vacuum cleaning systems.

Thus, the need exists for a universal adapter sleeve which can be mounted on the cleaning hose and then sealingly inserted into the inlet opening of the inlet tube of a variety of manufacturer's inlet valves without effecting the sealing efficiency thereof and also provides the electrical contact means.

SUMMARY OF THE INvENTION

Objectives of the invention include providing a universal adapter sleeve for central vacuum cleaning systems which is usable with a number of different manufacturer's inlet valves in which the interior bore of the inlet opening of the valve tube will vary in contour, slope and length.

A still further objective is to provide such a universal adapter sleeve which is adaptable for use with a variety of central vacuum cleaning systems inlet valves, which valves may or may not have a pair of spaced, contact buttons located at various locations within the valve inlet opening in order to provide the same ON/OFF action upon insertion and removal of the hose sleeve from the inlet tube as occurs when the particular manufacturer's sleeve of the central vacuum cleaning system is used; and which provides a sufficiently tight frictional sealing engagement between the adapter sleeve and inner wall of the inlet valve tube to prevent escape or passage of air therebetween.

A still further objective of the invention is to provide such a universal adapter sleeve which is formed with a series of annular zones spaced axially along a front end of the adapter sleeve, in which each of the zones has a particular angle of taper and length with respect to the angle or taper and lengths of the corresponding zones; and in which one of the zones contains an electrically conductive material, preferably an annular metal band, specifically located for engaging the various contact buttons of the various central vacuum cleaning system manufacturer's inlet valves.

A still further objective of the invention is to provide such an adapter sleeve preferably molded as a one-piece member of an elastomeric vinyl having a Shore A hardness of approximately $92 \pm 5$ which enables the sleeve to expand and contract slightly as it is inserted into the inlet tube of the inlet valve to provide an efficient seal therewith.

Still another objective of the invention is to provide such a universal adapter sleeve in which one end of the sleeve is cylindrical and has an internal grooved bore for securing an end of a usual flexible cleaning hose therein; and in which the sleeve can be used with inlet valves having electrical contact buttons formed therein or in valves without such buttons without effecting the manner of operation of the sleeve and/or inlet valve and centrally installed vacuum producing apparatus.

Still another objective of the invention is to provide such a universal adapter sleeve which can be mass produced by usual molding procedures of the type currently used to form the individual custom designed hose sleeves which matches the specific valve of the particular manufacturer's vacuum cleaning system.

These objectives and advantages are obtained by the improved adapter sleeve of the invention, the general nature of which may be stated as including a hollow sleeve for connecting a flexible hose to a vacuum source, said sleeve being of the type which is slidably inserted into an inlet opening of an inlet tube of an inlet valve, said sleeve including an elongated body having a hose attachment rear end portion and an inlet tube engaging front end portion, said rear end portion being adapted to be connected to a flexible hose with the front end portion being formed of an electrical insulation material and adapted to be slidably inserted into the inlet opening of the inlet tube; said front end portion having a plurality of axially spaced annular zones for selectively frictionally engaging portions of the inlet tube when inserted therein, said zones comprising first, second and third conical zones, a fourth zone containing an electrical conductive material, and fifth and sixth conical zones.

BRIEF DESCRIPTION OF THE DRAWINGS

A preferred embodiment of the invention illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

The improved universal adapter sleeve of the invention is indicated generally at 1, and is shown particularly in FIGS. 1–5. Sleeve 1 preferably includes a one-piece molded member or body 6 formed of an elastomeric vinyl preferably having a Shore A hardness of 92±5.

Figure 1:
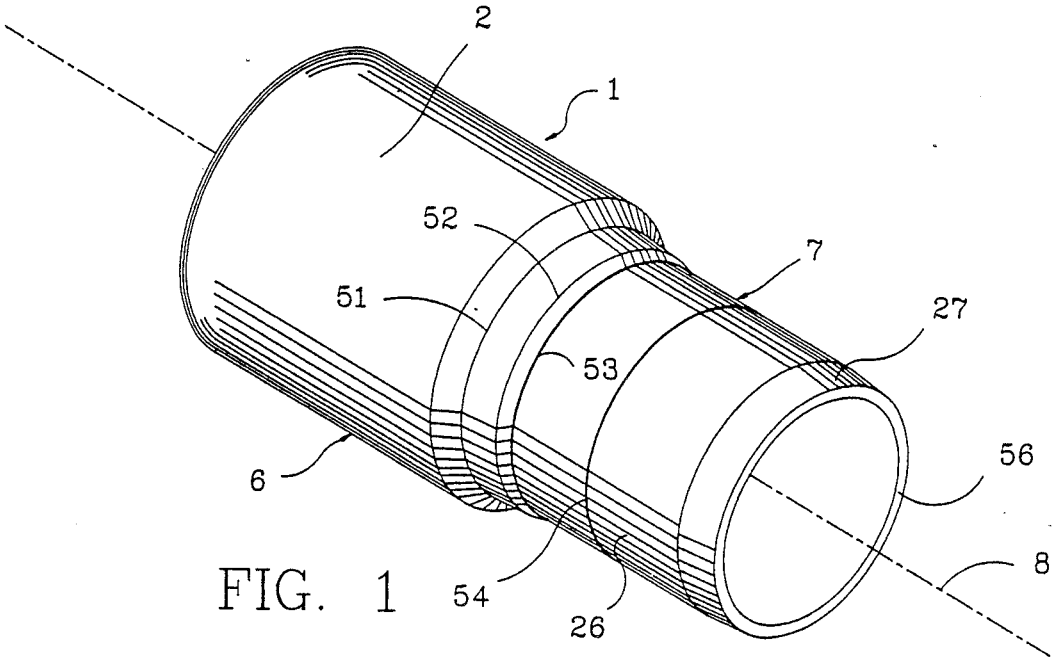
FIG. 1 is a perspective view of the universal adapter sleeve of the invention.
Figure 2:
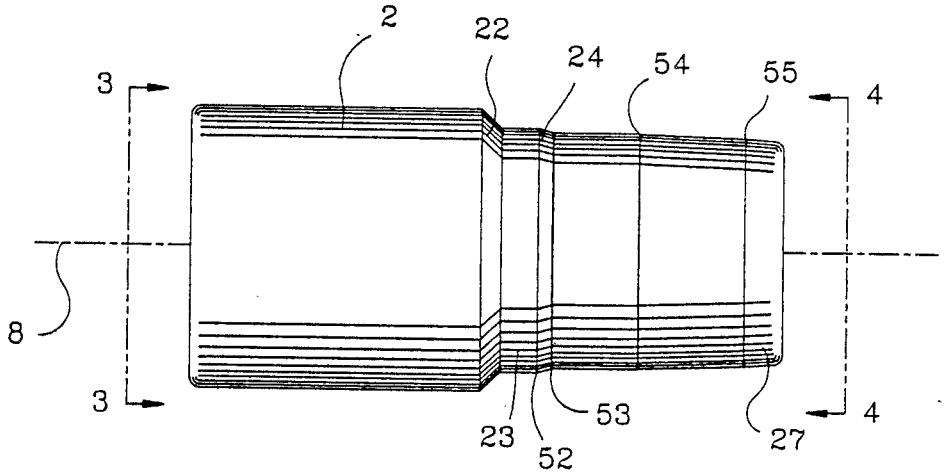
FIG. 2 is a side elevational view of the sleeve.
Figure 3:
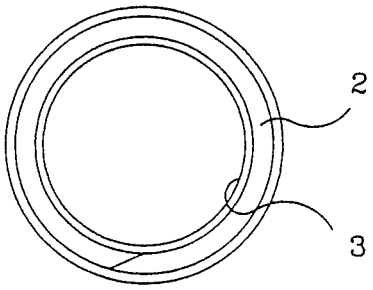
FIG. 3 is an end elevational view looking in the direction of arrows 3—3, FIG. 2.
Figure 4:
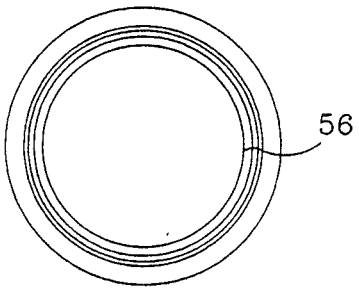
FIG. 4 is an end elevational view looking in the directions of arrows 4—4, FIG. 2.
Figure 5:
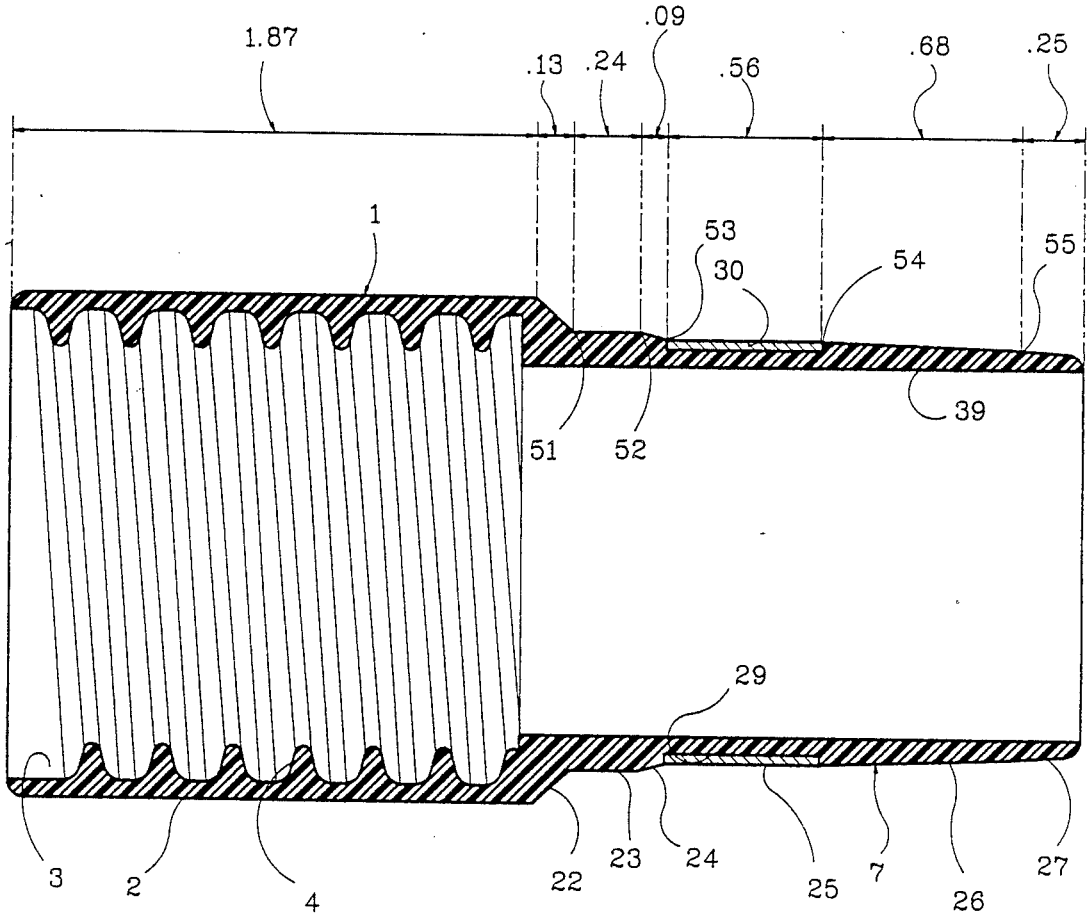
FIG. 5 is an enlarged longitudinal sectional view of the adapter sleeve as shown in FIG. 2.

Body 6 includes a rear end or hose attachment portion 2, preferably having a cylindrical configuration with a hollow internal bore 3 (FIG. 5). Bore 3 is provided with a grooved configuration 4 to assist in retaining a flexible cleaning hose 5 (FIG. 6) therein by usual attachment means.

Figure 6:
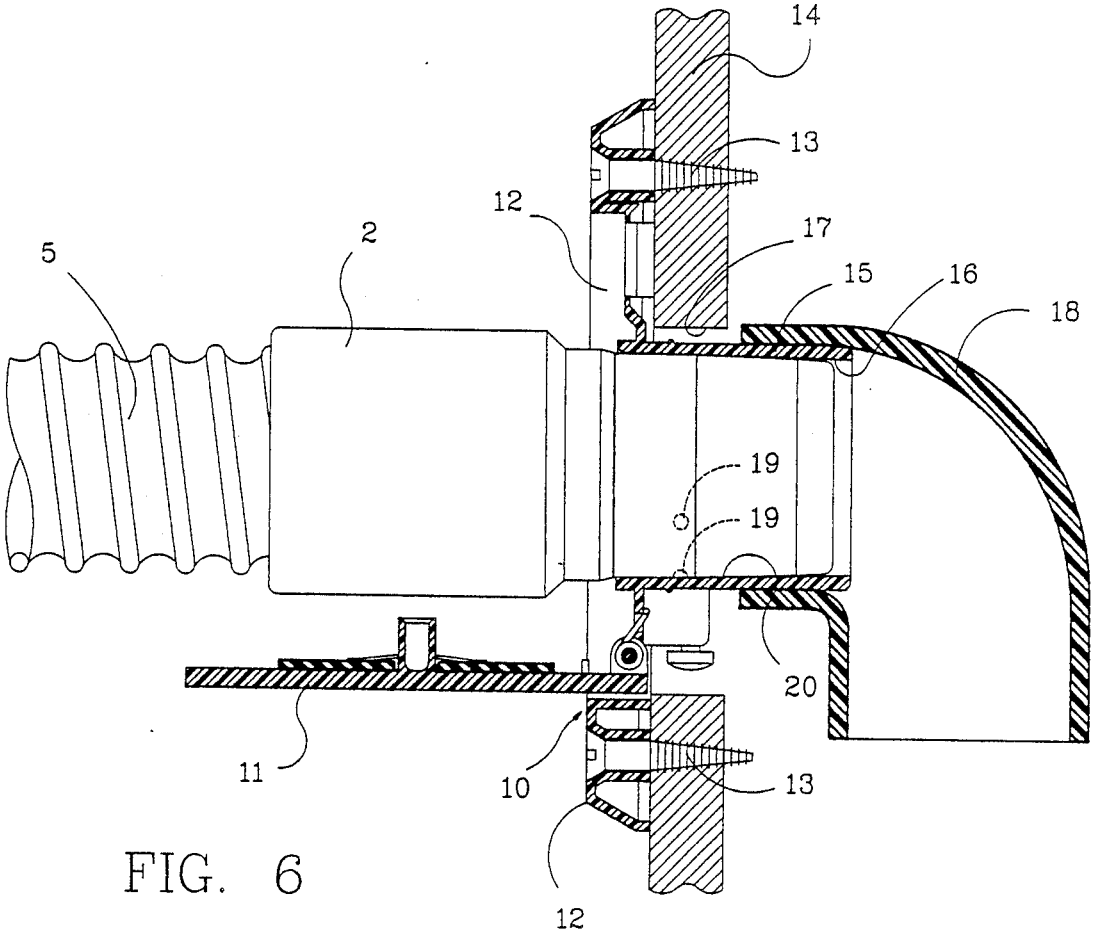
FIG. 6 is a diagrammatic view, portions of which are in section, of the adapter sleeve of the invention inserted into one type of inlet valve of a central vacuum cleaning system.

In accordance with the main feature of the invention, body 6 has a front end portion indicated generally at 7, which is formed with a plurality of annular zones spaced axially with respect to the longitudinal central axis 8 of body 6. Front end portion 7 enables adapter sleeve 1 to be frictionally sealingly engaged within a plurality of various inlet valves of a central vacuum cleaning system, one of which is shown in FIG. 6 and indicated generally at 10. Referring to FIG. 6, inlet valve 10 is of a usual construction, one type of which is shown in U.S. Pat. No. 3,283,093. Valve 10 usually is provided with a pivotally mounted lid 11, and a generally flat body portion 12 which is attached by a plurality of screws 13 on a outer surface of a wall 14 or on top of a floor or similar supporting structure. Inlet valve 10 includes a inlet tube 15 having a hollow inlet opening 16, with tube 15 extending through a complementary shaped opening 17 formed in wall 14. A conduit 18 is connected to inlet tube 15 and extends to a remotely located centrally installed vacuum producing apparatus as is common in built-in central vacuum cleaning systems. This apparatus generally includes an electric vacuum producing motor mounted at a remote location, such as in the basement, closet or similar location.

The particular construction of inlet valve 10 will vary somewhat between various manufacturers but usually has the general overall configuration as that described above and shown in FIG. 6. Certain of the inlet valves will have a limit switch (not shown) which extends outwardly from the front of body portion 12 which is moved to an ON position upon pivotal movement of lid 11 to the open position as shown in FIG. 6 for automatically energizing the remotely located electric motor. Other inlet valves such as shown in FIG. 6, are provided with a pair of metal contact buttons 19 which project into inlet opening 16 and are aligned with and engaged by an annular metal band formed on the front end portion of the inserted sleeve for completing the circuit between the spaced buttons for actuating the vacuum producing apparatus.

Also, the longitudinal length and angular taper of the interior annular surface 20 which defines inlet opening 16, will vary between the various manufacturers as well as the location of contact buttons 19. It is these differences which prevent the heretofore known hose sleeves from being able to be easily interchanged between a number of the different manufacturers inlet valves.

Figure 5A:
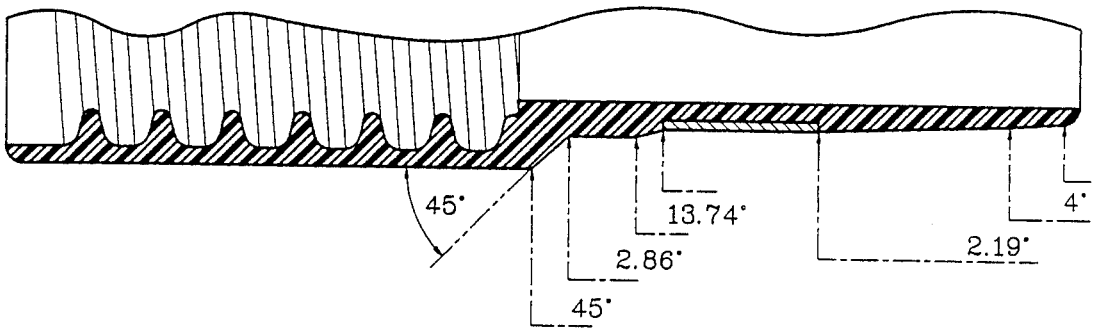
FIG. 5A is a fragmentary sectional view of the adapter sleeve as shown in FIG. 5, with the various angles of taper of the annular zones being indicated thereon.

Referring particularly to FIGS. 5 and 5A, the front end portion 7 of adapter sleeve 1 is formed with six annular zones indicated by numerals 22 through 27. Hereinafter these zones are specifically referred to as first zone 22, second zone 23, third zone 24, fourth zone 25, fifth zone 26 and sixth zone 27. In order to enable sleeve 1 to be used with a considerable number of inlet valves of various manufacturers of central vacuum cleaning systems, zones 22–27 have various lengths, angles of taper and axial locations with respect to each other. Zone 25 is provided with an electrically conductive material, also located at a specific axial location with respect to the other zones, in order to provide contact with the different manufacturers locations of contact buttons 19.

In the preferred embodiment, rear end cleaning hose attachment portion 2 will have a length of 1.87 inches or approximately 2 inches, with front end portion 7 having a length of 1.95 inches or approximately 2 inches. First zone 22 has a length of approximately 0.13 inches and an angle of taper of 45° with respect to axis 8 or an imaginary plane parallel thereto. Second zone 23 has a length of 0.24 inches and a taper of 2.86°. Third zone 24 has a length of 0.09 inches and a taper of 13.74°. Fourth zone 25 is provided with an annular recess 29 and has an annular metal band 30 seated therein to provide the contact with the various metal contact buttons 19 of the inlet valves. Zone 25 in the preferred embodiment, has a length of 0.56 inches and extends generally parallel with central axis 8. The fifth zone 26 has a length of 0.68 inches and a taper of 2.19° and the sixth zone 27 has a length of 0.25 inches and a angle of taper of approximately 4°. These dimensions are found to be the most suitable for the preferred embodiment, in order to achieve the most efficient results.

In proportion, zones 22–27 have longitudinal lengths of generally 7%, 12%, 5%, 29%, 34% and 13%, respectively, with respect to the overall length of front end portion 7. Thus, as can be seen, fifth zone 26 has the greatest longitudinal length but the smallest angle of taper. Also, the second and sixth zones are approximately equal in longitudinal length with first zone 22 having the smallest longitudinal length but the greatest angle of taper. Also, the second and fifth zones have approximately the same angle of taper. Also, fourth zone 25 is located between the relatively sharp taper of third zone 24 and the extremely slight elongated length of fifth zone 26.

The particular dimensions and ratios set forth above can vary slightly and still achieve a satisfactory use with a variety of inlet valves. However, these particular relationships and lengths have found to provide the most satisfactory sealing effect with the most number of known inlet valves of various manufacturers.

Figure 9:
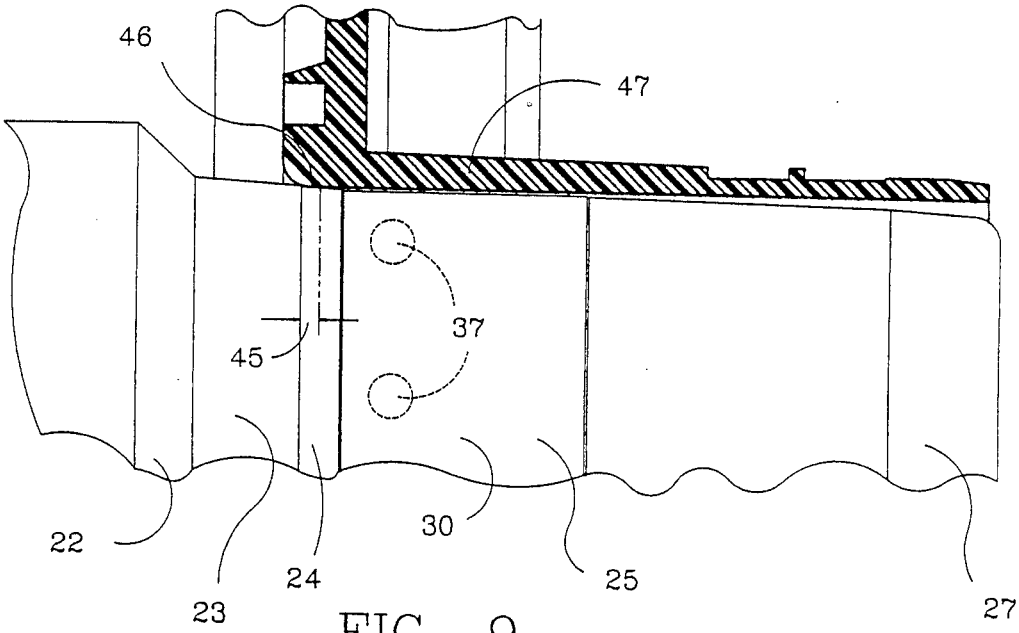
FIGS. 7, 8 and 9 are greatly enlarged fragmentary sectional views showing the universal adapter sleeve of the invention being engaged within three different types of inlet tubes of various manufacturer's inlet valves.
Figure 7:
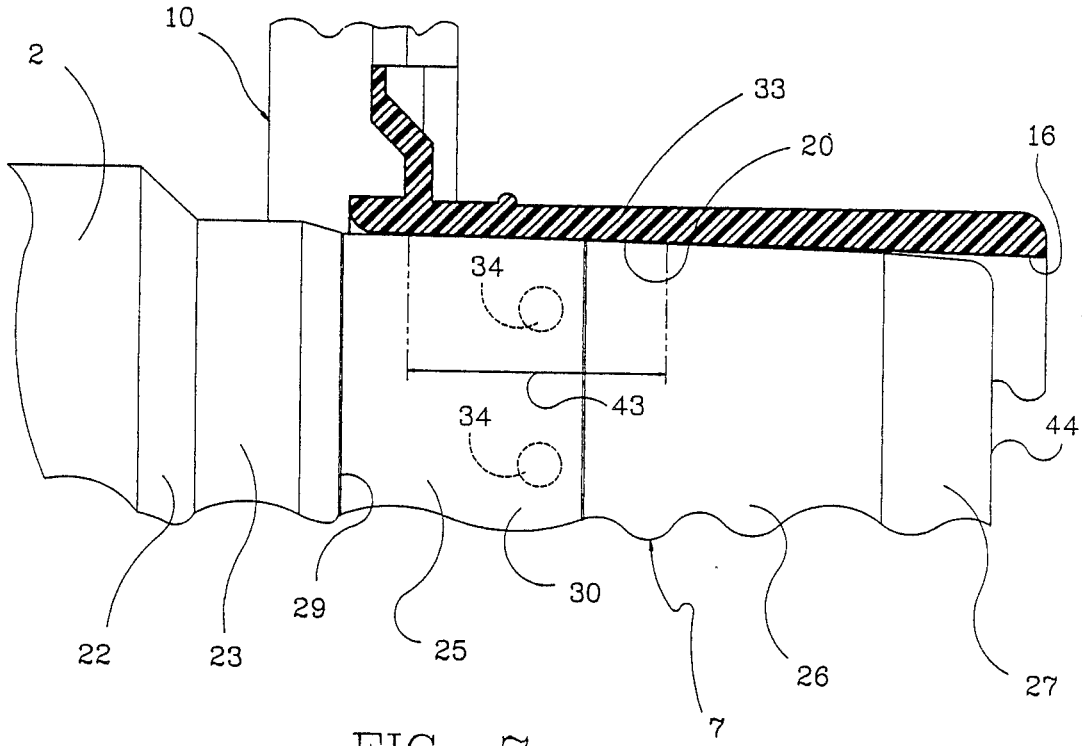
Figure 8:
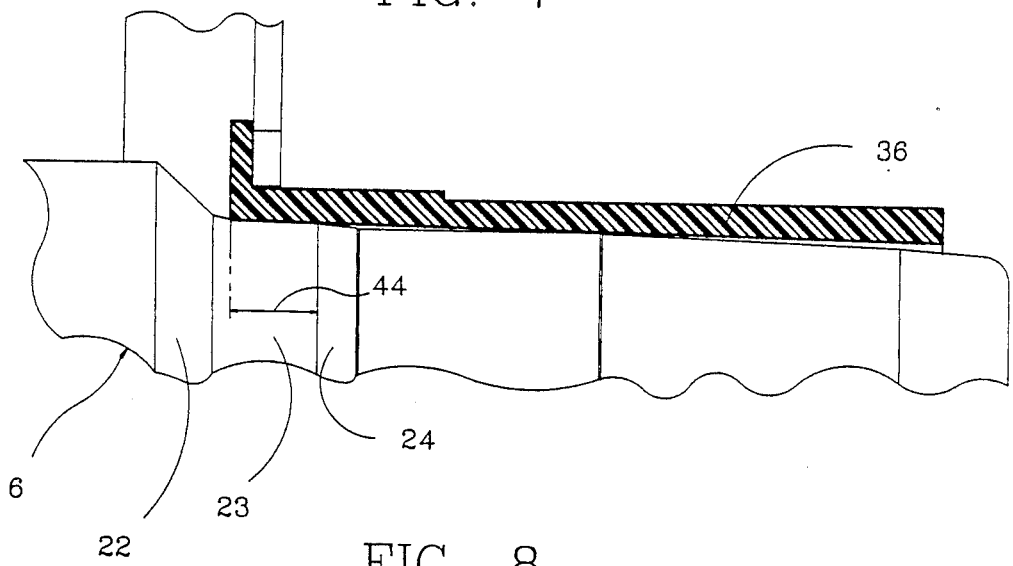

FIGS. 7, 8 and 9 show three varieties of different inlet valves and the manner that sleeve 1 is sealed therein. FIG. 7 shows an inlet valve having a inlet tube with a particularly angled bore forming wall 33 in which a sealing zone 43 is achieved principally by fourth zone 25 and an initial part of fifth zone 26, with contact buttons 34 engaging metal band 30 generally adjacent the forward end thereof. In this configuration, the first, second, third and sixth zones provides no sealing effect with bore wall 33 and will be completely disengaged from the inlet tube bore.

FIG. 8 shows a second type of sealing relationship in which a sealing zone 44 between sleeve 1 and a bore forming wall 36 is achieved principally by second sealing zone 23 with a rear portion of the zone being slightly compressed. This is a type of inlet valve having a lid actuated button and thus does not require the use of metal band 30 to provide the actuation for the remotely located vacuum producing apparatus.

FIG. 9 shows another inlet tube in which a sealing zone 45 is achieved entirely by third zone 24. Zone 24 will be compressed, due to the particular material of sleeve body 6 as discussed previously, to form a tight sealing relationship with a front annular wall portion 46 of inlet tube wall 47 with zones 22 and 23 being located externally of the inlet tube. Also, metal band 30 will be contacted by contact buttons 37 considerably closer to zone 24 than with buttons 34 for the inlet valve shown in FIG. 7. Thus there is a considerable difference in spacing between buttons 34 and 37 yet sleeve 1 provides the necessary electrical contact with metal band 30 and a sufficient frictional sealing relationship with various portions of body 6 to form the air tight fit.

It is easily seen that for other types of inlet tube configurations, the sealing effect could be achieved entirely by the first zone which due to the natural flexibility of sleeve body 6, can compress sufficiently to be forced into the inlet tube to maintain a tight frictional slip-fit engagement therewith. The fifth zone also may provide the entire sealing zone with certain other manufacturer's inlet tubes. The sixth zone may provide some sealing effect with certain inlet tubes but is used primarily to provide a converging guiding end for easily sliding front end portion 7 of body 6 into the inlet tube opening.

The inner annular wall surface 39 of front end portion 7 may have a very slight taper to enable sleeve 1 to be easily removed from its mold. However this taper will have very little effect on the operation of sleeve 1 since the particular tapers of the outer surface annular zones provide the sealing relationship with the interior surfaces of the various inlet tube openings.

In the preferred embodiment described above, the outer surface of hose attachment end portion 2 will have an outer diameter of approximately 1.8 inches. The junction of the first and second zones indicated at 51, will have an outer diameter of approximately 1.6 inches, with junction 52 between the second and third zones having an outer diameter of approximately 1.55 inches. Junction 53 formed between the third and fourth zones has an outer diameter of approximately 1.5 inches, with junction 54 formed between the fourth and fifth zones having an outer diameter of approximately 1.5 inches. Junction 55 formed between the fifth and sixth zones will have an outer diameter of approximately 1.44 inches.

Figure 10:
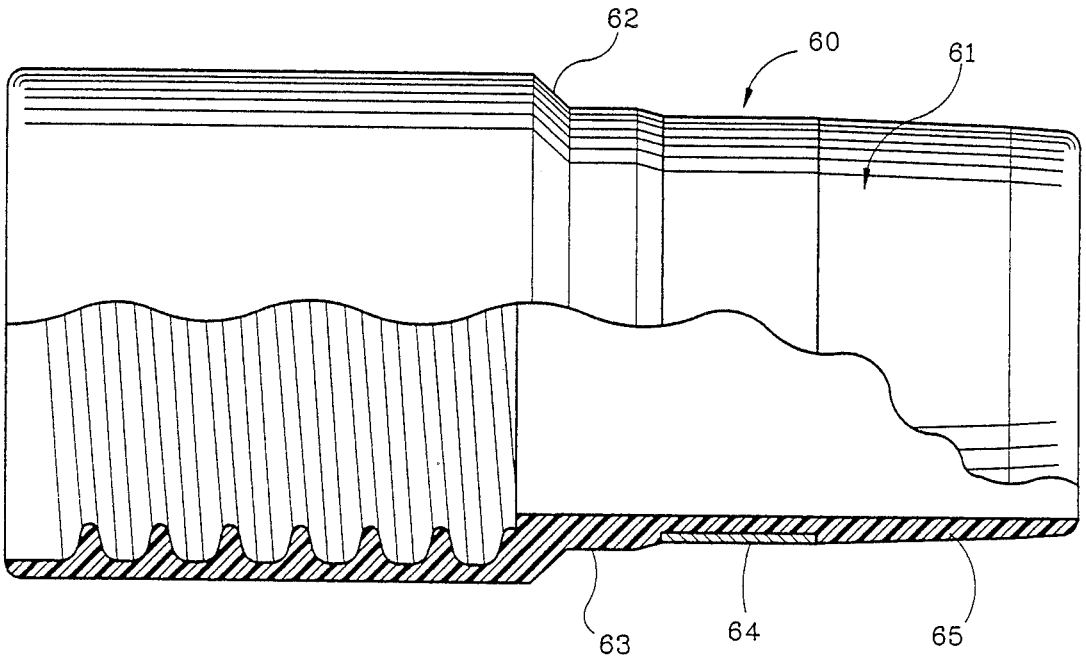
FIG. 10 is a sectional view similar to FIG. 5, showing the closest known prior art to the adapter sleeve of the present invention.

FIG. 10 illustrates the closest known prior art and shows a sleeve 60 having a front end portion 61 formed with a first conical zone 62, a generally horizontal zone 63 which contains a metal band 64 seated in a recess, and an end tapered zone 65.

In summary, the improved universal adapter sleeve provides an inexpensive, attachment sleeve for sealingly connecting a flexible hose of a vacuum cleaning system within the inlet opening of a variety of inlet valves of various manufacturers, in which the inlet opening forming walls have various lengths and tapers; and which also provides a metal contact band engageable with pairs of contact buttons whose locations also vary between various inlet valve manufacturers, to provide the automatic actuation of the remotely located vacuum producing apparatus. This is achieved by providing a front end portion on the sleeve having the particularly sized, angled and arranged series of axially spaced annular zones, nearly all of which are conical shaped and which converge toward annular front end 56 of the sleeve.

It is the particular locations and angles of taper of these various zones with respect to each other and with respect to the electrical conductive zone 25 which enables the satisfactory sealing effect to be achieved as well as the electrical actuating contact with a variety of inlet valve configurations not possible with prior hose sleeve constructions.

Accordingly the universal adapter sleeve for central vacuum cleaning systems is simplified, provides an effective, safe, inexpensive, and efficient device which achieves all the enumerated objective, provides for eliminating difficulties encountered with prior devices, and solves problems and obtains new results in the art.

In the foregoing description, certain terms have been used for brevity, clearness and understanding; but no unnecessary limitation are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved universal adapter sleeve for central vacuum cleaning systems is constructed and used, the characteristics of the construction, and the advantageous, new and useful results obtained; the new and useful structures, devices, elements, arrangements, parts and combinations, are set forth in the appended claims.

We claim:

1. A hollow sleeve for connecting a flexible hose to a vacuum source, said sleeve being of the type which is slidably inserted into an inlet opening of an inlet tube of an inlet valve, said sleeve including an elongated body having a hose attachment rear end portion and an inlet tube engaging front end portion, said rear end portion being adapted to be connected to a flexible hose with the front end portion being formed of an electrical insulation material and adapted to be slidably inserted into the inlet opening of the inlet tube; said front end portion having a plurality of axially spaced annular zones for selectively frictionally engaging portions of the inlet tube when inserted therein, said zones comprising first, second and third conical zones, a fourth zone containing an electrical conductive material, and fifth and sixth conical zones said six zones each having different tapers, with the longitudinal lengths of each of the six zones with respect to the overall length of the front end portion being approximately 7%, 12%, 5%, 29%, 34%, and 13%, respectively.

2. A hollow sleeve for connecting a flexible hose to a vacuum source, said sleeve being of the type which is slidably inserted into an inlet opening of an inlet tube of an inlet valve, said sleeve including an elongated body having a hose attachment rear end portion and an inlet tube engaging front end portion, said rear end portion being adapted to be connected to a flexible hose with the front end portion being formed of an electrical insulation material and adapted to be slidably inserted into the inlet opening of the inlet tube; said front end portion having a plurality of axially spaced annular zones for selectively frictionally engaging portions of the inlet tube when inserted therein, said zones comprising first, second and third conical zones, a fourth zone containing an electrical conductive material, and fifth and sixth conical zones, with the angles of taper of said first, second, third, fifth and sixth zones with respect to the longitudinal axis of the sleeve being approximately 45°, 3°, 14°, 2° and 4°, respectively.

3. The sleeve defined in claim 1 in which the first zone has a greatest angle of taper of all of the conical zones.

4. The sleeve defined in claim 2 in which the fifth zone has the greatest longitudinal length of all of the zones.

5. The sleeve defined in claim 1 in which the fourth zone includes a recess and an annular metal band seated in said recess.

6. The sleeve defined in claim 5 in which the recess and metal band extend generally parallel to a longitudinal axis of the front end portions.

7. The sleeve defined in claim 1 in which the fifth zone has the smallest angle of taper of all of the conical zones.

8. The sleeve defined in claim 2 in which the second and sixth zones are approximately equal in longitudinal length.

9. The sleeve defined in claim 2 in which the first zone has the smallest longitudinal length of all of the zones.

10. The sleeve defined in claim 1 in which the second and fifth zones have approximately the same angle of taper.

11. The sleeve defined in claim 2 in which the longitudinal lengths of each of the six zones with respect to the overall length of the front end portion are approximately 7%, 12%, 5%, 29%, 35%, and 13%, respectively.

12. The sleeve defined in claim 1 in which the angles of taper of the first, second, third, fifth and sixth zones with respect to the longitudinal axis of the sleeve are approximately 45°, 3°, 14°, 2° and 4° respectively.

13. The sleeve defined in claim 1 in which the front end portion of the sleeve has a longitudinal length of approximately 2 inches.

14. The sleeve defined in claim 13 in which the rear end portion has a longitudinal length of approximately 2 inches.

15. The sleeve defined in claim 1 in which the rear end portion is generally cylindrical and is formed with an internally grooved hollow bore.

16. The sleeve defined in claim 1 in which the sleeve is a one piece member formed of an elastomeric vinyl having a shore a hardness of 92±5.

* * * * *